United States Patent [19]

Hedgewick et al.

[11] 3,971,623

[45] July 27, 1976

[54] ROADWAY MARKER

[75] Inventors: Peter Hedgewick, Windsor, Canada; Donald C. Suhr, Farmington Hills, Mich.; John F. Domaracki; Robin A. Arnott, both of Windsor, Canada

[73] Assignee: International Tools (1973) Ltd., Windsor, Canada

[22] Filed: Mar. 13, 1975

[21] Appl. No.: 558,181

[52] U.S. Cl. ..... 350/103; 350/97; 404/11; 404/12

[51] Int. Cl.² ..... G02B 5/124

[58] Field of Search ..... 350/97, 289, 299, 288, 350/293, 103; 404/10, 12, 14, 8, 9, 11, 22, 23

[56] References Cited

UNITED STATES PATENTS

| | | | |
|---|---|---|---|
| 1,647,012 | 2/1927 | Morris | 404/11 |
| 1,830,319 | 7/1928 | Hartzler | 404/10 |
| 2,708,858 | 10/1950 | Shazon | 350/97 |
| 3,392,639 | 7/1968 | Heenan et al. | 404/12 |
| 3,466,985 | 9/1969 | Richardson et al. | 404/11 |
| 3,485,148 | 12/1969 | Heenan | 404/12 |

OTHER PUBLICATIONS

Merks Index of Chemical & Drugs – 7th edition, 1960, p. 192.

*Primary Examiner*—John K. Corbin
*Assistant Examiner*—B. Wm. delos Reyes
*Attorney, Agent, or Firm*—Reising, Ethington, Barnard, Perry & Brooks

[57] ABSTRACT

A pavement marker having a shell-like body with a chamber formed therein, the body being at least partially of transparent material to form a transparent outer wall for the chamber so that the interior of the chamber is visible through the transparent outer wall. Marker elements are located in the chamber so as to be visible through the transparent wall of the chamber. The body has a continuous, or endless, peripheral edge portion that lies in a base plane. The body projects from the base plane and is of dome-like configuration to define the chamber. A closure plate is secured to the body at the peripheral edge portion thereof to close the chamber. The closure plate, either before or upon installation on the surface of a roadway, is sealed to the body to hermetically seal the chamber. Either daytime or nighttime marker elements, or both, may be provided in the chamber so as to be visible through the transparent wall thereof. The chamber may be divided into a plurality of compartments by ribs integrally formed on the body, and various combinations of daytime and nighttime marker elements may be positioned in the chamber so as to be visible through the outer wall of the chamber.

46 Claims, 25 Drawing Figures

ROADWAY MARKER

BACKGROUND OF THE INVENTION

1. Field of the Invention

This invention relates generally to pavement markers, and is particularly concerned with pavement markers of the type that utilize retro-directive reflecting elements, such as cube corner reflecting elements, or other reflecting material for reflecting light from vehicles traveling over the roadway on which the pavement marker is secured. However, the invention also has use in pavement markers that are non-reflective in the sense that such markers are used only as daytime markers.

2. Description of the Prior Art

It has become common practice to delineate traffic lanes and the edges of roadways by pavement markers having retro-directive reflector elements or other relfecting material for reflecting the lights from vehicles traveling over the roadways at night. Such pavement markers are superior to painted strips on the roadway since, under poor weather conditions, painted strips on the roadway are not visible.

Generally, the reflective pavement markers are interspersed among non-reflecting pavement markers, or "daytime" markers which may be painted white, yellow or other desired colors to, for example, delineate the center line of a roadway or the dividing line between adjacent trafic lanes. As an example, every fifth pavement marker may be a "nigh-time" marker, i.e. a marker operable to reflect light rays from vehicles traveling at night, the other pavement markers serving solely as daytime markers. Typically the pavement markers are secured to the surface of the roadway by an adhesive, such as an epoxy resin. An area approximately four inches square is cleaned, as by sand blasting, and is then covered with a layer of epoxy resin. The pavement marker, either of the daytime type or night-time type, is then placed on the resin and is secured in position when the adhesive sets.

Typical examples of night-time pavement markers are disclosed in U.S. Pat. Nos. 3,332,327 and 3,409,344. The latter patents disclose pavement markers having retro-directive reflector elements of the cube corner type formed thereon. The cube corner reflector elements are formed on an outer wall of the pavement marker, which outer wall is frequently engaged by the wheels of vehicles traveling over the roadway. In order to provide adequate strength to withstand the forces imposed by the vehicle wheels, the pavement marker bodies are filled with epoxy resin or the like. In order to protect the cube corner reflector elements from moisture and chemical attack, the surface of the reflector elements are metallized. While the metallized layer performs the function of protecting the reflector elements, it also causes a loss of optical efficiency. Optical efficiency is further reduced due to the requirement that the synthetic resin wall on which the reflector elements are formed must be of great enough thickness to withstand the shock loads imposed by vehicle wheels. As the thickness of the material increases, there is greater absorption of light in the material to reduce the reflective power.

SUMMARY OF THE INVENTION

An object of the present invention is to provide a pavement marker utilizing a reflector member having retrodirective reflector elements wherein the reflector member is not directly subjected to the impact and shock loads imposed by vehicle wheels.

A further object of the present invention is to provide a low-cost, light-weight, rugged pavement marker which can utilize a reflector member having retro-directive reflector elements wherein the reflector member is received in a hermetically sealed chamber to maintain optimum optical efficiency of the reflector elements.

A further object is to provide a pavement marker wherein either daytime or night-time marker elements, or both, can be inserted into the pavement marker body as desired at the time of installation onto the surface of the roadway.

A further object is to provide a pavement marker having a body with a chamber formed therein and in which can be inserted either daytime or night-time marker elements, or both, and hermetically sealed upon installation onto the surface of a roadway.

Another object is to provide a shell-like body for a pavement marker of unitary, ribbed construction that does not require an internal filler in order to withstand the shock loads of vehicle wheels.

In carrying out the foregoing, and other objects, a pavement marker according to the present invention includes a shell-like body of dome-like configuration to form a chamber. The body has an endless peripheral edge portion that lies substantially in a base plane, the body projecting from the base plane to form the chamber, the peripheral edge portion of the body enclosing an access opening to the chamber. In the preferred embodiment, the body is of transparent material to form a transparent outer wall for the chamber so that the interior of the chamber is visible through the transparent outer wall, and marker means is located in the chamber so as to be visible through the transparent wall thereof. A closure plate engages the peripheral edge portion of the body to close the chamber and, at least on installation, hermetically seal the chamber.

The marker means may comprise either daytime or night-time marker elements, or both. The daytime marker elements may be provided by one or more flanges projecting from the closure plate and having opaque surfaces visible through the transparent wall of the chamber. The opaque surfaces may be colored as desired to provide any desired signal. The night-time marker elements may comprise reflector members operable to reflect light rays incident on the transparent wall of the chamber. The reflector members preferably have retro-directive reflector elements, such as cube corner reflector elements, formed on one surface. Since the reflector member is received in a hermetically sealed chamber and is protected so as not to be directly subject to the shock loads of vehicle wheels, it can be of minimum thickness so as to provide maximum optical efficiency. The optical efficiency is further enhanced by the elimination of the necessity to metallize or otherwise coat the surface of the retro-directive reflector elements.

In order to prevent the accumulation of moisture within the hermetically sealed chamber, a desiccant, such as activated alumina, calcium chloride, silica gel, or zinc chloride may be provided in the chamber. Preferably the desiccant is pressed into a sheet or a thin plate that can be disposed in the chamber in position that is out of the path of incident and reflected light rays.

In the preferred embodiment, the pavement marker body has a main rib that extends transversely of the fore and aft axis of the body (i.e. the axis that is parallel to the direction of travel when the pavement marker is installed on a roadway surface) and has a lower edge lying in the base plane and an upper edge integrally joined to the inner surface of the body within the chamber. The front and rear outer walls extend outwardly in opposite directions from the upper edge of the main rib and downwardly to the base plane, and a pair of spaced, longitudinal ribs parallel to the fore and aft axis are joined integrally to the main rib and to the inner surface of the body within the chamber to form central compartments in the chamber on opposite sides of the main rib.

The outer walls are curved outwardly and downwardly to the base plane, and also are curved inwardly toward the main rib on opposite sides of the fore and aft axis.

Side marker compartments are formed in the chamber on opposite sides of the longitudinal ribs for receiving side marker elements. The side marker elements may be in the form of daytime marker members which are received in slots between transverse ribs extending between the longitudinal ribs and the end portions of the outer walls. Alternatively, the side marker elements may be in the form of nighttime marker members having retro-directive reflector elements formed thereon. The retrodirective reflector elements of the side marker members may have their axes disposed at an acute angle with respect to the fore and aft axis of the body to provide high reflectivity of light rays striking the surface of the side marker element at an acute angle.

In one embodiment, a metal base member is provided having oppositely directed base flanges located in the base plane, and connected together by end sections of dished configuration to engage the opposite ends of the pavement marker body. The pavement marker body may be of either glass or transparent synthetic resin.

In another embodiment, the peripheral edge portion of the body is circular, and a pair of ribs intersect each other at the center of the peripheral edge portion, the ribs being perpendicular with respect to each other and having an upper edge portion joined integrally to the inner surface of the body to divide the chamber into quadrants. Marker elements are disposed against the portion of each of the ribs located in each quadrant so that the body can be located at an intersection of two roads to reflect light from four directions at 90° from each other.

Other objects, advantages and features of the invention will become apparent from the following description taken in connection with the accompanying drawings.

DETAILED DESCRIPTION OF THE PREFERRED EMBODIMENTS

Figure 1:
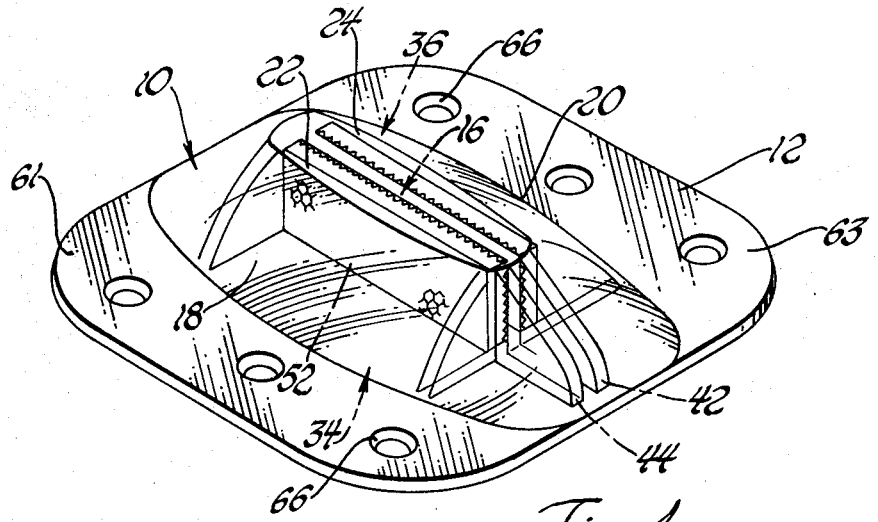
FIG. 1 is a perspective view of a pavement marker according to the present invention.
Figure 2:
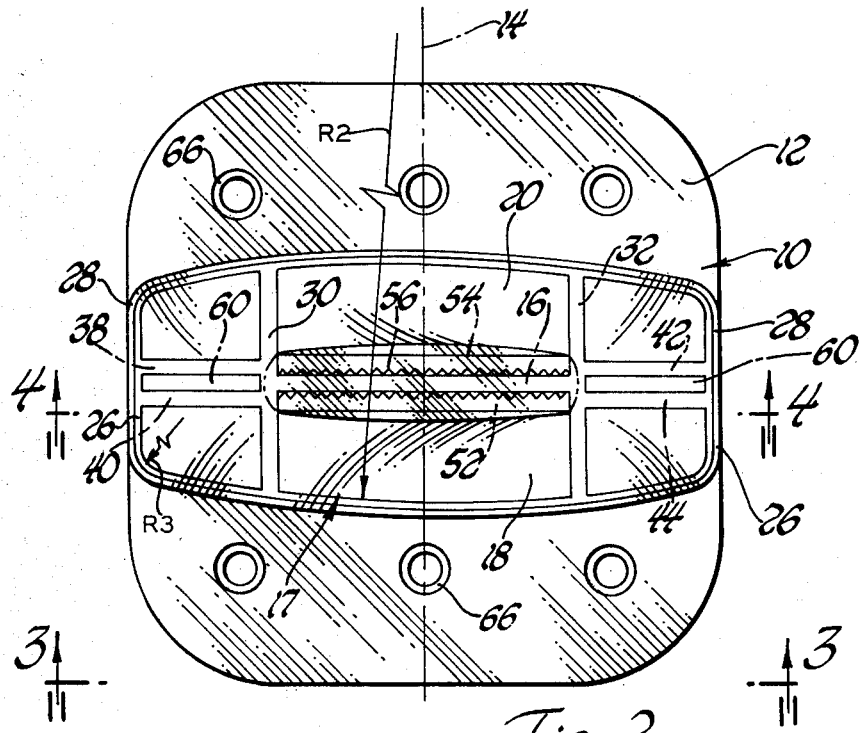
FIG. 2 is a top plan view of the pavement marker of FIG. 1.
Figure 3:
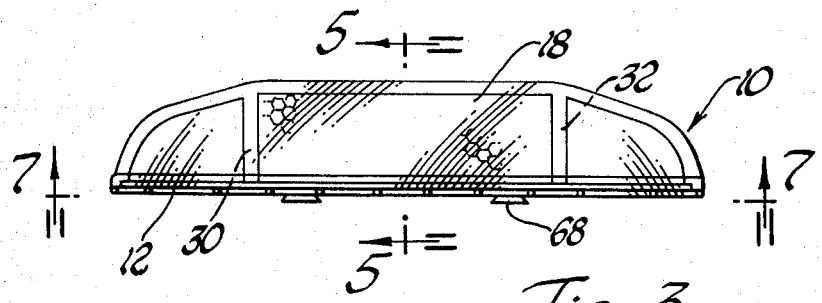
FIG. 3 is an elevational view taken on lines 3—3 of FIG. 2.

In FIGS. 1–7, reference numeral 10 collectively designates a shell-like body having a base member 12 for engagement with the surface of a roadway. In FIG. 2, the fore and aft axis of the pavement marker is indicated by reference numeral 14, which fore and aft axis extends parallel to the direction of travel of vehicles when the pavement marker is installed on the surface of a roadway.

Figure 4:
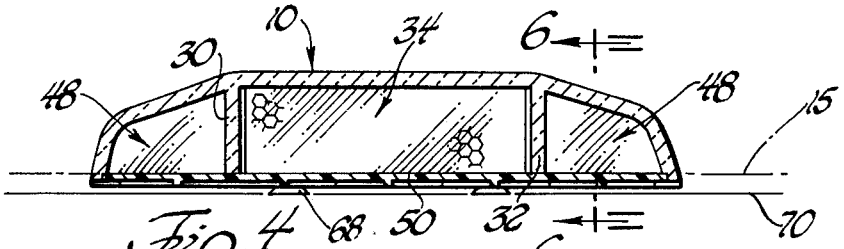
FIG. 4 is a sectional view taken on lines 4—4 of FIG. 2.
Figure 5:
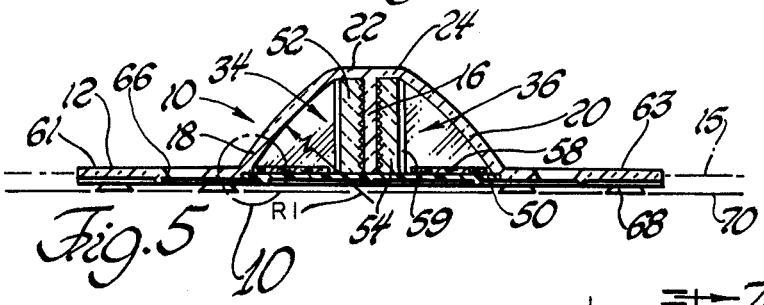
FIG. 5 is a sectional view taken on lines 5—5 of FIG. 3.
Figure 6:
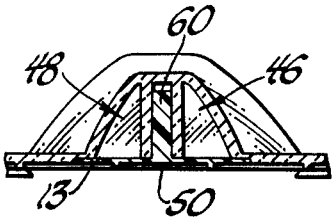
FIG. 6 is a sectional view taken on lines 6—6 of FIG. 4.

In FIGS. 4 and 5, reference numeral 15 indicates a base plane, and the body 10 has an endless peripheral edge portion 13 lying in the base plane 15. The body 10 is of dome-like configuration and projects from the base plane to define a chamber 17 with its inner surface, the chamber having an access opening enclosed by the endless peripheral edge portion 13. The base plane 15, as shown in FIGS. 4 and 5, is located approximately midway between the upper and lower surfaces of the base member 12.

The body 10 is formed with an upright main rib 16 located in chamber 17 and extending transversely of the fore and aft axis 14. The main rib 16 has a lower edge lying in the base plane 15 and an upper edge integrally joined to the inner surface of the body 10 (FIG. 5). A pair of outer walls 18 and 20 extend outwardly in opposite directions from the upper edge of the main rib 16 and downwardly to the base plane. As shown in FIG. 5, the outer walls 18 and 20 curve outwardly and downwardly to the base plane from substantially horizontal flat portions 22 and 24 projecting in opposite directions from the upper edge of the main rib 16. The radius of curvature of the outer walls 18 and 20 in the vertical plane is indicated at R1 in FIG. 5, and, in the specific illustrated embodiment, and by way of example only, R1 is 3 inches. The outer wall 18 also curves inwardly from its intersection with the fore and aft axis 14 toward the main rib 16 on opposite sides of the fore and aft axis with a radius of curvature at the base indicated at R2 in FIG. 2. In the specific illustrated embodiment, and by way of example only, R2 is 10 inches. The outer wall 20 is similarly curved inwardly from the fore and aft axis about a radius equal to the radius R2 in FIG. 2. Stated another way, the body 10 is symmetrical about the central plane of the main rib 16.

The outer wall 18 has opposite end portions 26 which curve abruptly inwardly toward the plane of the main rib 16 and extend generally parallel to the fore and aft axis 14. Similarly, the outer wall 20 has opposite end portions 28 curving abruptly inwardly toward the plane of the main rib 16 and extending generally parallel to the fore and aft axis. Each end portion 26 of the outer wall 18 is joined integrally to an end portion 28 of the outer wall 20. The end portions 26 and 28 turn abruptly inwardly from the respective outer walls 18 and 20 about a radius indicated at R3 at FIG. 2, which, in the specific illustrated embodiment, by way of example only, is 0.75 inches.

Figure 7A:
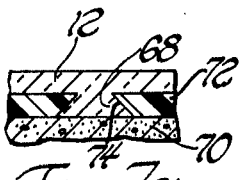
FIG. 7*a* is an enlarged sectional detail view taken on lines 7*a*—7*a* of FIG. 7.
Figure 7:
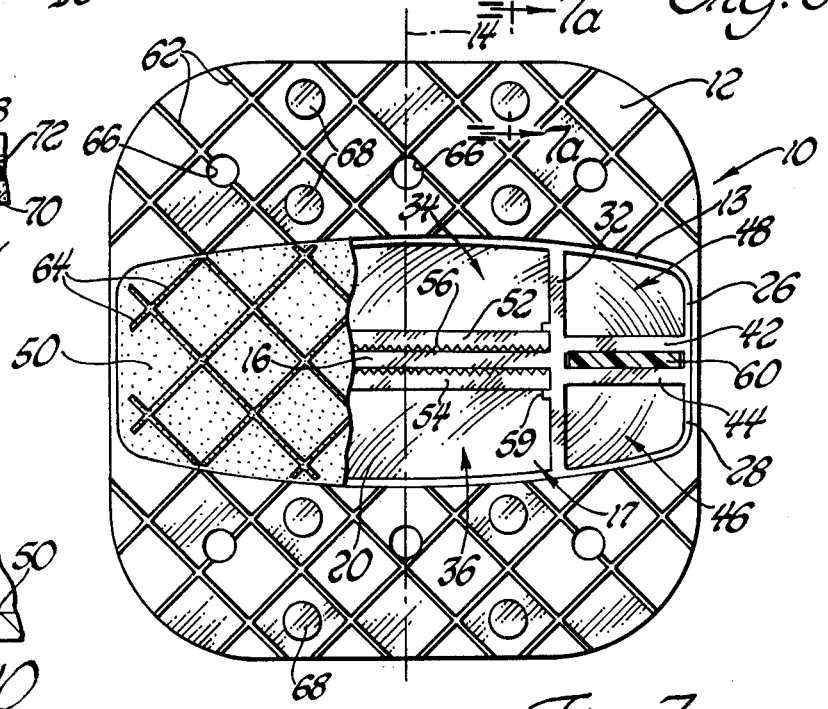
FIG. 7 is a bottom plan view taken on lines 7—7 of FIG. 3.

The body 10 includes a pair of spaced, parallel longitudinal ribs 30 and 32 located on opposite sides of the fore and aft axis 14 (FIG. 2). The longitudinal ribs 30 and 32 are joined integrally to the main rib 16 and to the inner surface of the body 10 to form central compartments 34 and 36 in the chamber 17 on opposite sides of the main rib 16 (FIGS. 5 and 7).

A pair of spaced, parallel transverse reinforcing ribs 38 and 40 extend from the longitudinal rib 30 to the end portions 28 and 26 of the outer walls 20 and 18, respectively. Ribs 38 and 40 have upper edges that are inclined downwardly and outwardly from the longitudinal rib 30 toward the end portion 26, 28 (see particularly FIGS. 3 and 4). Similarly, a pair of spaced, parallel transverse reinforcing ribs 42 and 44, identical to ribs 38 and 40, extend between the longitudinal rib 32 and the end walls 28 and 26 of the outer walls 20 and 18, respectively. The transverse ribs 38–42 cooperate with the longitudinal ribs 30, 32 and outer walls 18 and 20 to define side compartments 48 in the chamber 17 at opposite ends of the central compartment 34, and side compartments 46 at opposite ends of the central compartment 36 (FIGS. 4 and 7).

As shown particularly in FIG. 5, the longitudinal ribs 30 and 32, and the transverse ribs 38–42, have lower, free edges located in the base plane 15 along with the peripheral edge portion 13 of the body 10. A closure plate 50 is engaged with the peripheral edge 13 of the body 10 to close the chamber 17, including the central compartments 34, 36 and side compartments 46, 48.

The closure plate 50 may be secured to the body 10 at the factory by sonic welding, for example, to hermetically seal the chamber 17. Alternatively, as described below, the closure plate 50 may be detachably secured to the body 10 so that the chamber 17 becomes hermetically sealed when the body 10, with the closure plate 50 detachably secured thereto, is seated in adhesive material on the surface of the roadway.

In the embodiment of FIGS. 1–7, the body 10 is of transparent material. The body 10 may be of glass, or of synthetic resin material such as polycarbonate or acrylic. With the body 10 of transparent material, the interior of the chamber 17, as well as each of the compartments 34, 36, 46 and 48 thereof are visible through the outer walls 18 and 20.

Marker means is located in the chamber 17 so as to be visible through the transparent outer walls 18 and 20 of the body 10. In the embodiment illustrated in FIGS. 1–7, the marker means includes central night-time marker elements 52 and 54 respectively located in the central compartments 34 and 36 of chamber 17 as well as a pair of daytime marker elements 60. The daytime marker elements 60 are each located between a pair of the transverse ribs 38, 40 and 42, 44. The night-time marker elements 52 and 54 are operable to reflect light rays incident on the outer walls 18 and 20 respectively. The daytime marker elements 60 have opaque surfaces visible through the outer walls 18 and 20 at the side marker compartments 46 and 48.

The central, nighttime marker elements 52 and 54 comprise reflector bodies, each of which has inner surfaces disposed in opposed relationship with the opposite surfaces of the main rib 16, which inner surfaces are formed with retro-directive reflector elements 56 (FIG. 2). In the preferred embodiment, the retro-directive reflector elements 56 are cube corner reflector elements, although other configurations of retro-directive reflector elements may be provided.

In order to prevent the accumulation of moisture within the chamber 17, sheets 58 of desiccant material, such as calcium chloride, are secured to the surface of the closure plate 50 within the chamber 17 as illustrated in FIG. 5. The sheets 58 of desiccant may be located in each of the compartments 34, 36, 46, 48 or in either of the compartments so long as there is atmospheric communication between the compartments. The longitudinal ribs 30, 32 may be apertured or notched to provide atmospheric communication between the compartments of the chamber 17 so that desiccant material can be located in only one of the compartments.

Locating projections 59 are formed on the longitudinal ribs 30 and 32 within the central compartments 34 and 36 (FIGS. 5 and 7) for engagement with the outer surfaces of the reflector members 52 and 54 at the ends thereof.

The base member 12 is formed integral with the body 10 in the embodiment of FIGS. 1–7 and includes flanges 61 and 63 projecting outwardly from the peripheral edge portion 13 of the body 10 along the base plane 15. The flange 61 projects outwardly from the lower edge of the outer wall 18, and the flange 63 projects outwardly from the lower edge of the outer wall 20.

A particular problem with pavement markers is that of maintaining the pavement marker in place on the roadway surface under the frequent shock loads imposed by the wheels of vehicles passing over the pavement marker. The shock loads imposed by the vehicle wheels frequently overcome the bond between the pavement marker and the adhesive material used to secure the pavement marker to the surface. In the embodiment of FIGS. 1–7, elongated ridges 62 project from the bottom surface of the flanges 61 and 63 of base 12. As shown in FIG. 7, the ridges 62 are formed in a criss-cross or diamond pattern on the bottom surface of the base 12. A similar diamond-shaped pattern of elongated ridges 64 project from the bottom surface of the closure plate 50. The ridges 64 are arranged in complementary relationship with the ridges 62, the bottom surface of the closure plate 50 forming a continuation of the bottom surface of the base member 12.

A plurality of holes 66 (three in the illustrated embodiment) are formed in each of the flanges 61 and 63 of the base member 12. Holes 66 are tapered, or countersunk, with the large end of each hole at the upper surface of the base member. Additionally, a plurality (four in the illustrated embodiment) of tapered support studs 68 project integrally from the bottom surface of each of the base flanges 61 and 63. As shown in FIG. 7*a*, the support studs 68 are of frusto-conical configuration with the small end joined integrally to the bottom surface of the base 12. The large end of the support studs 68 are engaged with the roadway surface indicated by reference numeral 70 in FIGS. 4, 5 and 7*a* to locate the base member 12 with respect to the surface 70 of the roadway. By way of example, the studs 68 may project beneath the bottom surface of the base member 12 a distance of one-sixteenth of an inch.

Reference numeral 72 (FIG. 7*a*) indicates epoxy resin, or similar adhesive material, for securing the pavement marker to the roadway surface 70. The epoxy resin surrounds the tapered surface 74 of the studs 68 to provide a direct mechanical lock resisting upward movement of the base member 12 relative to the road surface 70. Additionally, the holes 66, together with the ridges 62 and 64, provide a mechanical interlock between the base member 12 and the adhesive material 72 used to secure the base member to the pavement. Additional resistance to separation of the pavement marker from the surface is provided by the tapered holes 66 in the manner disclosed, for example, in U.S. Pat. No. 3,096,694. When the base member is pressed into the adhesive material, the adhesive oozes into the tapered holes 66 and, in effect, creates a rivet when the adhesive sets or hardens.

While the illustrated embodiment in FIGS. 1–7 shows nighttime reflector members 52 and 54 in the central compartments 34 and 36 on opposite sides of the main rib 16 for reflecting light in opposite directions, it is obvious that one of the reflector members 52 or 54 can be omitted where it is necessary to reflect light in only one direction.

Figure 8:
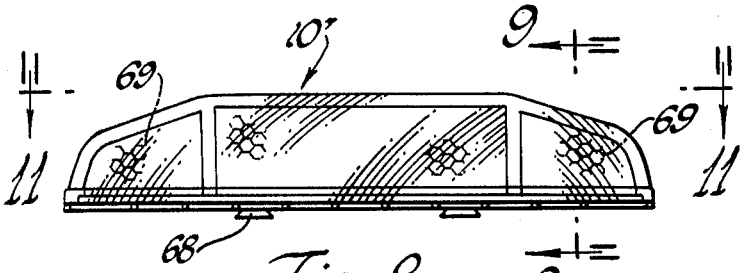
FIG. 8 is a view similar to FIG. 3 illustrating a modified form of the embodiment of FIGS. 1–7.
Figure 9:
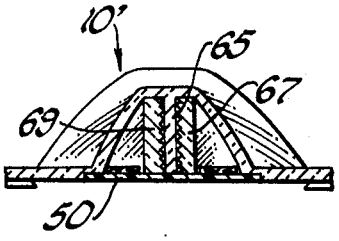
FIG. 9 is a sectional view taken on lines 9—9 of FIG. 8.
Figure 11:
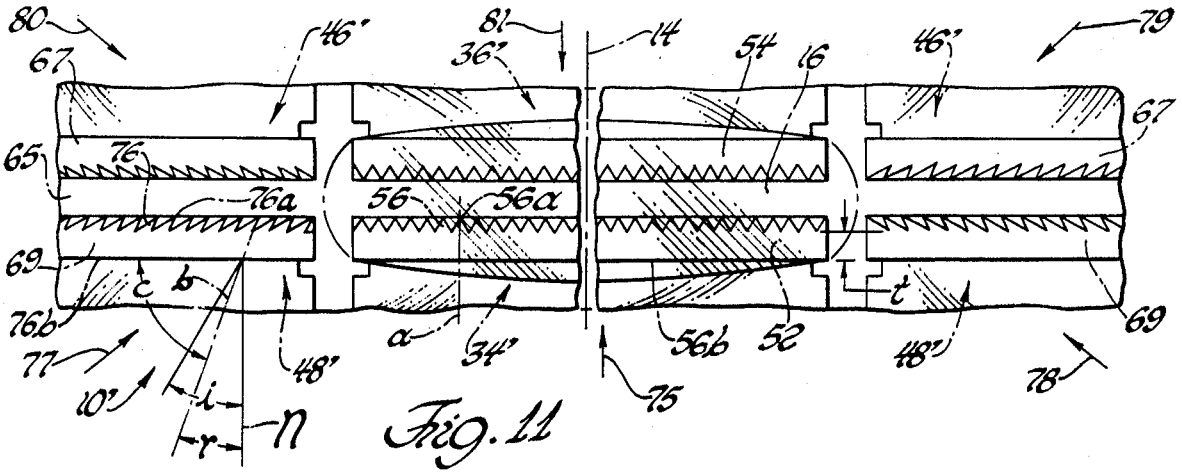
FIG. 11 is an enlarged fragmentary view taken on lines 11—11 of FIG. 8 illustrating one arrangement of marker elements in the embodiment of FIGS. 8 and 9.

FIGS. 8, 9 and 11 illustrate an embodiment of the invention wherein the daytime elements 60 are omitted, and nighttime side marker elements are provided in the side marker compartments to increase the nighttime reflectivity.

In FIGS. 8 and 9, reference numeral 10′ indicates a shell-like body identical to the body 10 of FIGS. 1–7 except that the spaced, parallel pairs of transverse ribs 38, 40 and 42, 44 are replaced by a single transverse rib 65. The rib 65 forms an extension of the main rib 16 in FIGS. 8 and 9.

In the pavement marker of FIGS. 8, 9 and 11, flanges 60 are omitted from the closure plate 50′. Nighttime side marker elements 67 and 69 are received in the side marker chambers 46′ and 48′, respectively, on opposite sides of the rib 65.

As in FIGS. 1 through 7, central nighttime marker elements 52 and 54 are located in central compartments 34′ and 36′ of the body 10′. As in FIGS. 1 through 7, the central nighttime marker elements 52 and 54 are in the form of reflector bodies having retrodirective reflector elements 56 formed on their inner surfaces (FIG. 11), and the reflector elements 56 are preferably of the cube corner type, with an apex or cube corner 56*a* disposed adjacent to the opposed surface of the main rib 16. The cube corner reflector elements 56 of the reflector bodies 52 and 54, as shown in FIG. 11, are of the type sometimes referred to as "square reflex" in that each of the cube corner reflector elements 56 has an axis a extending through its cube corner, or apex 56*a*, which axis is perpendicular to the outer face 56*b* so that the cube corner reflector elements 56 are aligned to have maximum reflectivity when the incident light is normal to the outer surface 56*b*. Hence, the axes a of the cube corner reflector elements 56 of the reflector body 52 in FIG. 11 are oriented to have maximum reflective capability when the incident light is in the direction of arrow 75 normal to the outer surface 56*b* of the reflector body 52.

The side marker elements 67 and 69 comprise reflector bodies formed with reflector elements, preferably cube corner reflector elements that are of the type sometimes referred to as "angled reflex", that is, the axes of the cube corner reflector elements are not normal or "square" to the outer surface of the reflector body. See, for example, British Pat. No. 441,319 and U.S. Pat. Nos. 3,392,639; 3,485,148 and 3,784,279, in addition to the above-referred to U.S. Pat. Nos. 3,332,327 and 3,409,344.

In FIG. 11, the side marker elements 69 are in the form of reflector bodies formed on their inner surfaces with retrodirective reflector elements 76, each having an apex 76*a*. Preferably, the reflector elements 76 are of the cube corner type, each having an axis *b* extending through its apex, or cube corner, 76*a*. Each axis *b* extends at an acute angle *c* with respect to the outer face 76*b* of the reflector body 69. Each axis *b* of each reflector element 76 also extends at an angle of refraction *r* with respect to the normal N to the outer face and with respect to the fore and aft axis 14 of the pavement marker, angle *r* being complementary to angle *c*. In the illustrated embodiment, angle *c* is seventy degrees and angle *r* is 20°. The reflector elements 76 of the left-hand reflector body 69 in FIG. 11 are thus oriented to have maximum reflectivity when the incident light striking the outer surface 76*b* of the reflector body is in the direction of arrow 77 at an angle of incidence *i* with respect to the normal N. The angle of incidence *i* is 20° in the illustrated embodiment of FIG. 11. The right-hand reflector body 69 in FIG. 11 is identical to the left-hand reflector body 69 except that the reflector elements of the left-hand reflector body 69 are oriented to have maximum reflectivity when the incident light is in the direction of arrow 78. The reflector bodies 67 in the side marker compartments 46′ are similar to the reflector bodies 69 with the reflector elements oriented to have maximum reflectivity when the incident light is in the direction of arrows 80 and 79, respectively. Thus, in FIG. 11, the central reflector bodies 52 and 54 have reflector elements oriented to have maximum reflectivity for incident light rays in the direction of arrows 75 and 81, respectively, with the side marker reflector bodies 67 and 69 having reflector elements oriented in a direction to have maximum reflectivity for light rays in the direction of arrows 77, 78, 79 and 80, respectively.

Figure 12:
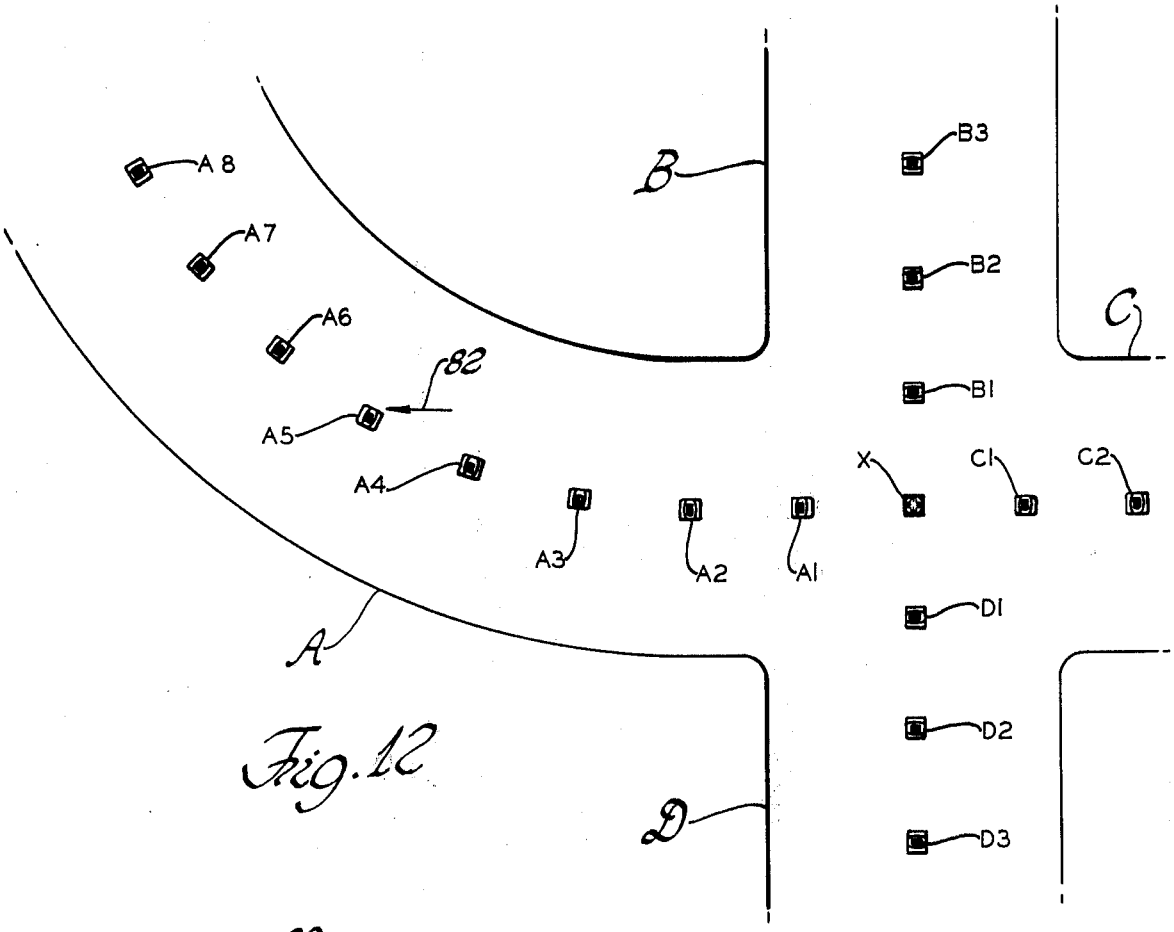
FIG. 12 is a plan view of a portion of a roadway system having pavement markers installed thereon according to the present invention.

The arrangement illustrated in FIG. 11 is particularly useful on curves where the direction of light from vehicles will strike the pavement marker at an acute angle to the fore and aft axis of the pavement marker. FIG. 12 illustrates a roadway having intersecting branches A, B, C and D. A pavement marker X is located at the intersection of the four branches. Pavement markers at the center line of branch A, starting from the intersection, are indicated A-1, A-2, A-3, etc. Pavement markers at the center line of branch B, starting from the intersection, are indicated at B-1, B-2, B-3, etc.; while those for branches C and D are indicated at C-1, C-2, etc. and D-1, D-2, etc., respectively. Branch A is shown in FIG. 12 as having a sharp curvature, and light rays from a vehicle traveling toward the left on branch A from the intersection will, at certain positions of the vehicle, be in the direction of arrow 82. If the pavement marker A-5 is of the type shown in FIG. 11, a side marker element similar to elements 67, 69 of FIG. 11 will provide high reflectivity of light rays in the direction of arrow 82.

Figure 10:
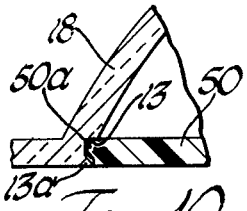
FIG. 10 is an enlarged detailed view of a modification of the area enclosed in circle 10 on FIG. 5.

While the closure plate 50 of FIGS. 1 through 7, and the closure plate 50' of FIGS. 8, 9 and 11, may be sealingly secured in place at the factory by sonic welding, or the like, the construction described thus far is such that the pavement markers can be assembled together at the time of installation onto the surface of a roadway. Hermetic sealing of the chamber 17, and the compartments 34, 36, 46 and 48 of chamber 17 (and the corresponding compartments in FIGS. 8, 9 and 11) will be accomplished by the epoxy resin, or other adhesive, used to secure the pavement marker to the roadway surface. The adhesive material will seal any space between the peripheral edge of the closure plate 50 (or 50') and the peripheral edge portion of the body 10 and base member 12 surrounding the closure plate. To assist in assembling the closure plate to the body 10, FIG. 10 illustrates a construction whereby the closure plate 50 may be detachably mounted on the body 10. In FIG. 10, a lip **13*a* projects from the lower edge of the shoulder depending from the peripheral edge portion 13. A bead 50*a* projects from the periphery of the closure plate 50 for snap engagement with the groove defined between the peripheral edge portion 13 and the lip 13*a*. The lip 13*a* may be provided around the entire periphery of the chamber 17**, or at portions only thereof.

To install the pavement marker on the roadway surface, an area of the roadway surface corresponding in size to the area of the base member 12 is cleaned, as by sandblasting, and is then covered with a layer of adhesive material, such as epoxy resin, having a viscosity that permits some control of the thickness of the layer prior to setting of the adhesive material. In the illustrated embodiment of FIGS. 1 through 7, the base member 12 is 4 inches square (or approximately 16 square inches in area except for the rounded corners). A preassembled pavement marker, for example, of the construction of FIGS. 1 through 7, may then be pressed into the adhesive material until the studs 68 come into contact with the roadway surface. The adhesive material is of a thickness such that some of the material is squeezed into the holes 66 to the level of the upper surface of the base member 12. When the adhesive material sets, the pavement marker is firmly anchored to the roadway.

The pavement marker can be assembled with any desired arrangement of marker elements at each site where a pavement marker is to be installed. For example, the number and colors of nighttime marker elements can be selected for each of the positions indicated at A-1, A-2, A-3, etc. and inserted into the chamber 17 of the pavement marker body 10. The closure plate can then be assembled to the body 10 with the desired arrangement of daytime marker elements, if any, and the assembled pavement marker placed in position on the site coated with adhesive material. The desiccant material can either be preassembled to the closure plate as indicated at 58 in FIG. 5 (or 58' in FIG. 9), or it can be inserted into the chamber 17, or each compartment thereof, prior to the installation of the closure plate.

Figure 13:
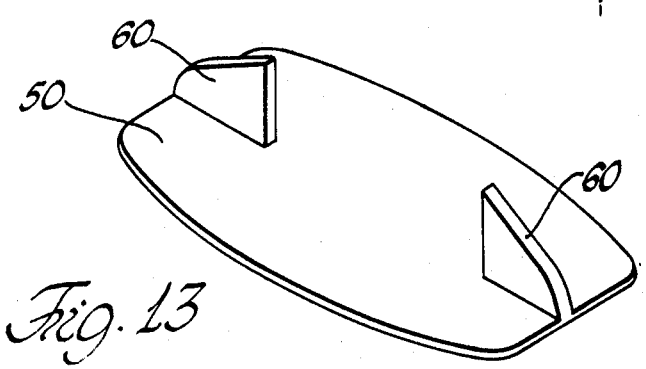
FIG. 13 is a perspective view of a closure plate having a pair of daytime marker flanges formed thereon of the type suitable for use with the embodiment of FIG. 1.
Figure 14:
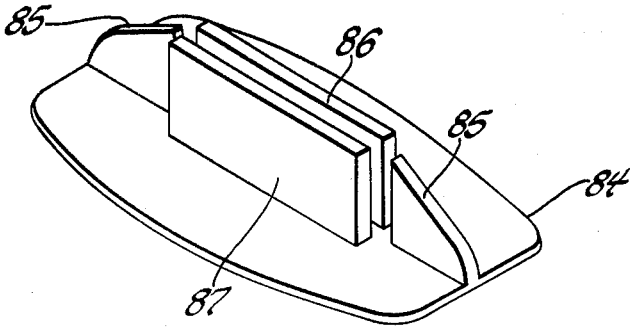
FIG. 14 is a perspective view of another form of closure plate formed with daytime marker elements.

If a particular position requires a pavement marker serving only as a daytime marker, an opaque marker can be inserted into one or both of the compartments 34 and 36 in place of the reflector bodies 52 and 54 illustrated in FIGS. 1 through 7. Such an arrangement, in combination with the closure plate 50 illustrated in FIGS. 1 through 7 and 13, will provide an arrangement having daytime marker elements visible both in the central and side marker compartments. Alternatively, the closure plate 84 in FIG. 14 may be substituted for the closure plate 50 of FIG. 13. The closure plate 84 includes side marker elements 85 identical to the side marker elements 60 of FIG. 13, as well as central, opaque daytime marker elements 86 and 87. The marker elements 86 and 87 project upwardly from the closure plate 84 in spaced, parallel relationship, so that the main rib 16 can be received between the marker elements 86 and 87. The various opaque marker elements 85, 86 and 87 can be colored as desired to provide the desired signal.

Figure 15:
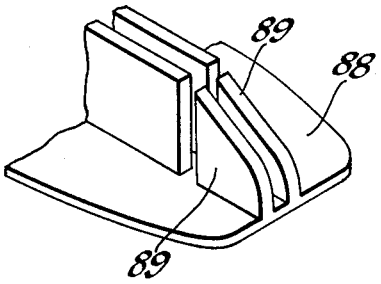
FIG. 15 is a partial perspective view of another closure plate formed with another arrangement of daytime marker elements.

FIG. 15 illustrates still another version of a closure plate for providing solely daytime marker capabilities for the marker body 10' shown in FIGS. 8 and 9. The closure plate 88 in FIG. 15 includes a pair of opaque side marker flanges 89 spaced from each other so as to receive the rib 65, the flanges 89 replacing the reflector bodies 67 and 69 in FIG. 11.

The construction described thus far provides several advantages. The use of the shell-like body 10 (or 10') permits flexibility in the arrangement of marker elements used with the body 10. Furthermore, as discussed above, on side assembly is possible so that the arrangement of marker elements can vary from location to location, as desired, while at the same time utilizing the shell-like body 10 at each location. Since the nighttime reflector bodies 52, 54, 67, 69 are not subject directly to the impact forces of vehicle wheels, the reflector bodies can be thin so that there is a minimum of light absorbed in the material of the reflector bodies. For example, the thickness $t$ of the reflector bodies 52 and 69 in FIG. 11, in the specific embodiment of the invention, is 0.040 inches, which is substantially less than the thickness generally required where the reflector body is directly subject to the force and impact of vehicle wheels.

Since the reflector bodies are received in the chamber 17 in a stress-free condition, there is no problem caused by the effects of stress distortion of the reflector bodies on the optical properties thereof. Location of the reflector bodies in the hermetically sealed chamber 17 eliminates the necessity for metalizing or otherwise coating the reflector elements. The configuration of the shell-like body 10 (and 10') in FIGS. 1 through 11 provides a self-cleaning effect from the contact with vehicle tires. The ribbed reinforcement of the shell-like body provides a lightweight, high-strength construction that eliminates the necessity of providing a fill for the pavement marker shell. The studs 68 serve to locate the position of the base member of the pavement marker relative to the roadway surface, which in turn, serves as a control for the amount of adhesive material required to secure the pavement marker to the surface. Furthermore, the studs 68, in cooperation with the ridges 62, 64 and holes 66 provide both horizontal and vertical anchoring of the pavement marker to the roadway surface.

While the reflector bodies 52, 54, 67 and 69 are protected by the walls of the shell-like body 10, 10' from the impact of vehicle wheels, the reflector bodies do reinforce the body 10, 10' against such impact forces.

Figure 16:
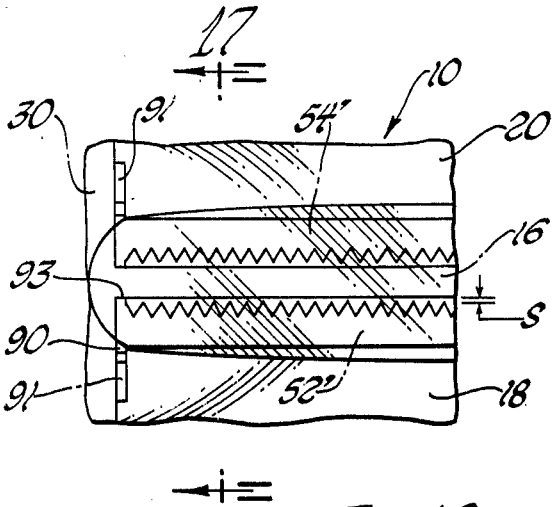
FIG. 16 is a fragmentary top plan view, similar to FIG. 11, of a portion of a pavement marker according to the present invention illustrating a detail.
Figure 17:
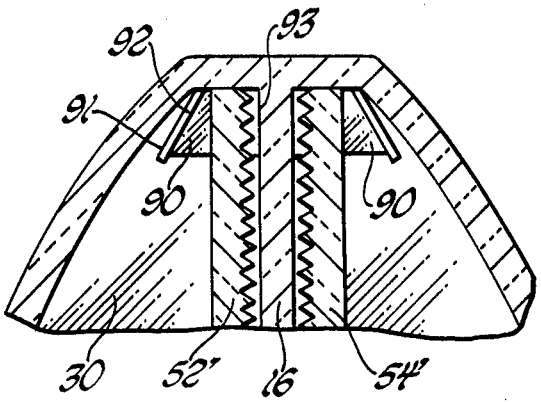
FIG. 17 is a sectional view taken on lines 17—17 of FIG. 16.

FIGS. 16 and 17 illustrate a construction wherein the reflector bodies can be firmly secured in position adjacent to the main rib 16, and at the same time are isolated from mechanical stresses. Reflector bodies 52' and 54' are formed on each end with a wedge-like mounting tab 90. The mounting tab 90 has an outer edge that is inclined downwardly and outwardly with respect to the main rib 16 (FIG. 17) so as to engage an inclined locating projection 91 integrally formed on the longitudinal rib 30. The locating rib 91 is also inclined downwardly and outwardly with respect to the main rib 16. The mounting tab 90 has an inner edge 93 that is vertical in the illustrated embodiment and engages the surface of rib 16 to maintain a space indicated at *s* in FIG. 16 between the apices of the reflector elements and the ribs 16. The mounting tab 90 is wedged between the locating projection 91 and rib 16 to firmly secure the reflector bodies 52' and 54' in position without imposing mechanical stresses on the reflector bodies.

Figure 18:
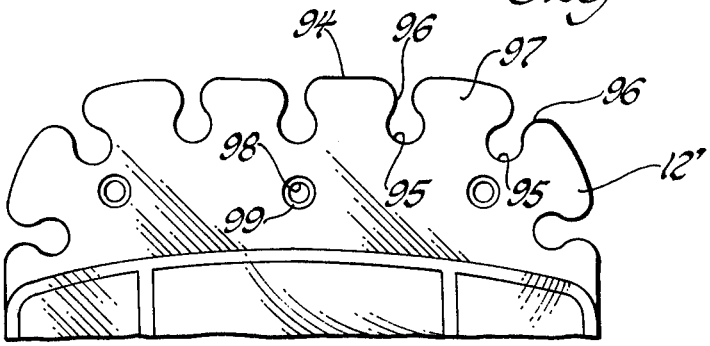
FIG. 18 is a partial plan view of a pavement marker with a modified base flange.

FIG. 18 illustrates a pavement marker similar to the embodiment of FIGS. 1 through 7 having a modified base member 12'. The base member 12' is formed at its edges with notches to provide a scalloped configuration of the base member. The notches 95 in the illustrated embodiment of FIG. 18, have enlarged circular portions connected with the peripheral edge 94 by neck portions 96. Tongue portions 97 are defined between each adjacent pair of the notches 95. Adhesive material flows into the notches 95 when the pavement marker is secured to the pavement to increase the bond between the surface of the roadway and the pavement marker. Holes 98 are also formed in the base member 12', the holes 98 being countersunk as indicated at 99 to cooperate with adhesive material to form a mechanical interlock between the base member 12' and the adhesive material.

FIGS. 19 through 22 illustrate a modified form of the invention wherein the pavement marker includes a transparent, shell-like body or capsule used in conjunction with a separate base member of stamped sheet metal, or the like. In FIGS. 19–22, reference numeral 110 collectively designates a shell-like body or capsule in which is mounted nighttime marker elements, and reference numeral 112 collectively designates a stamped sheet metal base member for engagement with the surface of a roadway.

Figure 19:
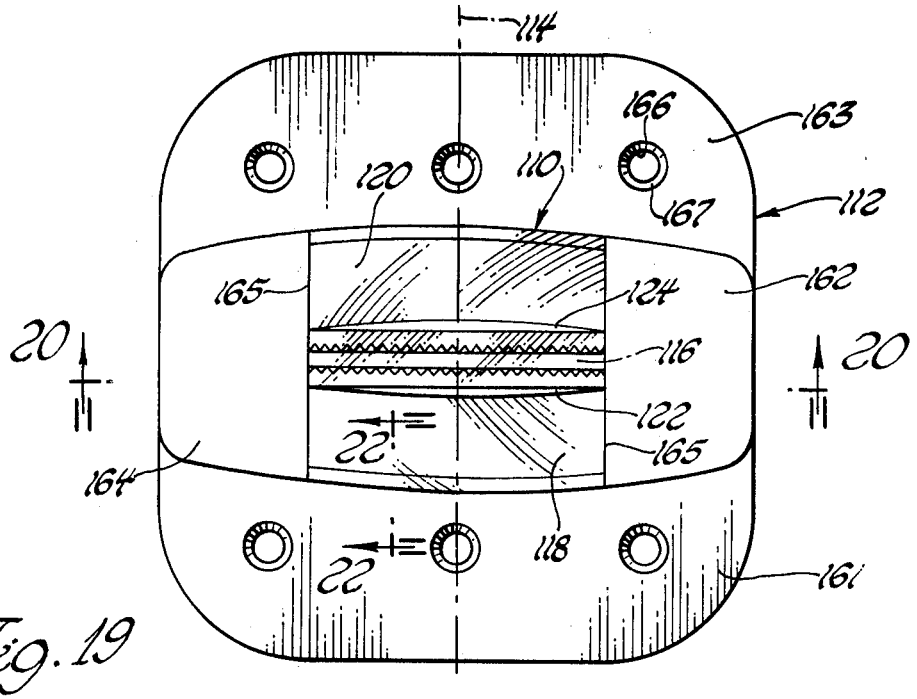
FIG. 19 is a plan view of a second embodiment of a pavement marker according to the present invention having a separate, metal base member.

In FIG. 19, the fore and aft axis of the pavement marker is indicated by reference numeral 114 which fore and aft axis extends parallel to the direction of travel of vehicles when the pavement marker is installed on the surface of a roadway, as in the previously described embodiments.

Figure 20:
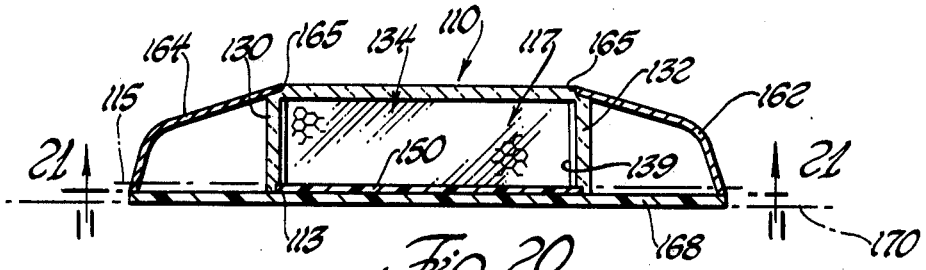
FIG. 20 is a sectional view taken on lines 20—20 of FIG. 19.
Figure 22:
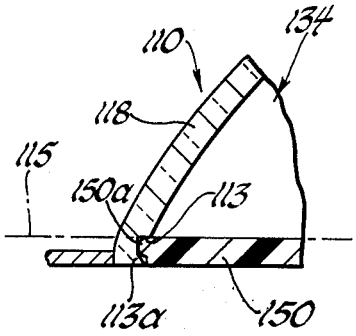
FIG. 22 is a sectional, detailed view taken on lines 22—22 of FIG. 19.

In FIGS. 20 and 22, reference numeral 115 indicates a base plane, and the body 110 has an endless peripheral edge portion 113 lying in the base plane 115. The body 110 is of dome-like configuration and projects from the base plane 115 to define a chamber 117 with its inner surface, the chamber 117 having an acess opening enclosed by the endless peripheral edge portion 113.

The body 110 is formed with an upright main rib 116 located in chamber 117 and extending transversely of the fore and aft axis 114. The main rib 116 has a lower edge lying in the base plane 115, and an upper edge integrally joined to the inner surface of the body 110. A pair of outer walls 118 and 120 extend outwardly in opposite directions from the upper edge of the main rib 116 and downwardly to the base plane 115. The outer walls 118 and 120 have the same configuration as the walls 18 and 20 of the embodiment of FIGS. 1–7 and curve outwardly and downwardly to the base plane 115 from substantially horizontal flat portions 122 and 124 projecting in opposite directions form the upper edge of the main rib 116. The flat portions 122 and 124 correspond to the flat portions 22 and 24 of FIGS. 1–7.

The side walls of the body 110 are formed by longitudinal ribs 130 and 132 corresponding to the longitudinal ribs 30 and 32 of the embodiment of FIGS. 1–7. The body 110 is of substantially identical construction to that portion of the body 10 of the embodiment of FIGS. 1–7 which includes the central compartment 34 and 36, the side marker compartments of the body 10 being omitted in the body 110. Thus, in the embodiment of FIGS. 19–22, the chamber 117 of body 110 is divided by the main rib 116 into central compartments 134 and 136.

A closure plate 150 is engaged with the peripheral edge 113 of the body 110 to close the chamber 117, including the central compartments 134 and 136 on opposite sides of the main rib 16. As in the previously described embodiment of FIGS. 1–7, the closure plate 150 may be secured to the body 110 by sonic welding, for example, to hermetically seal the chamber 17. Alternatively, the closure plate 150 may be detachably secured to the body 110 so that the chamber 117 becomes hermetically sealed when the body 110, with the closure plate 150 detachably secured thereto, is seated in adhesive material on the surface of a roadway.

For detachably securing the closure plate 150 to the body 110, a lip **113*a* may be formed on the lower edge of the body 110, similar to the construction shown in FIG. 10 for snap engagement by a bead 150*a* formed on the periphery of the closure plate 150**.

In the embodiment of FIGS. 19–22, the body 110 is of transparent material. The body 110 may be of glass, or synthetic resin material such as polycarbonate or acrylic.

As in the previously described embodiment, marker means is located in the chamber 117 so as to be visible through the transparent outer walls 118 and 120 of the body 110. The marker means includes central nighttime marker elements 152 and 154 respectively located in the central compartments 134 and 136 of chamber 117. The marker elements 152 and 154, as in the previously described embodiment, are in the form of reflector bodies which are identical in construction to the reflector bodies 52 and 54 of the embodiment of FIGS. 1–11. Hence, the central, nighttime marker elements 152 and 154 comprise reflector bodies, each of which has inner surfaces disposed in opposed relationship with the opposite surfaces of the main rib 116, which inner surfaces are formed with retro-directive reflector elements, preferably of the cube corner type.

As in the previously described embodiment, desiccant material (not shown) is located in the chamber 117, or each compartment 134, 136 thereof, to prevent the accumulation of moisture.

Locating projections 139 are formed on the side walls or ribs 130 and 132 within the central compartment 134 and 136 for engagement with the outer surfaces of the reflector bodies 152 and 154 at the ends thereof.

The base member 112 is in the form of a sheet metal stamping having oppositely extending flanges 161 and 163 connected by end sections 162 and 164 of dished configuration. The inner peripheral edge of the end sections 162 and 164 engage shoulders 165 extending around the periphery of the side walls 130 and 132 at the junction with the outer walls 118 and 120. The dished end portions 162 and 164 may be painted any desired color to serve as daytime marker elements located at the sides of the central, nighttime marker elements received in the capsule 110.

The base flanges 161 and 163 are formed with holes 166 which are countersunk or dimpled as indicated at 167 for cooperation with the adhesive material.

With reference to FIG. 20, the surface of the roadway is indicated at 170, and a layer of epoxy resin or other adhesive material is indicated at 168. The resin 168 cooperates with the holes 166 to anchor the metal base member 112 to the roadway surface 170. The adhesive material 168 also hermetically seals the body 110 by filling any cracks or spaces at the peripheral edge of the closure plate 150.

Figure 23:
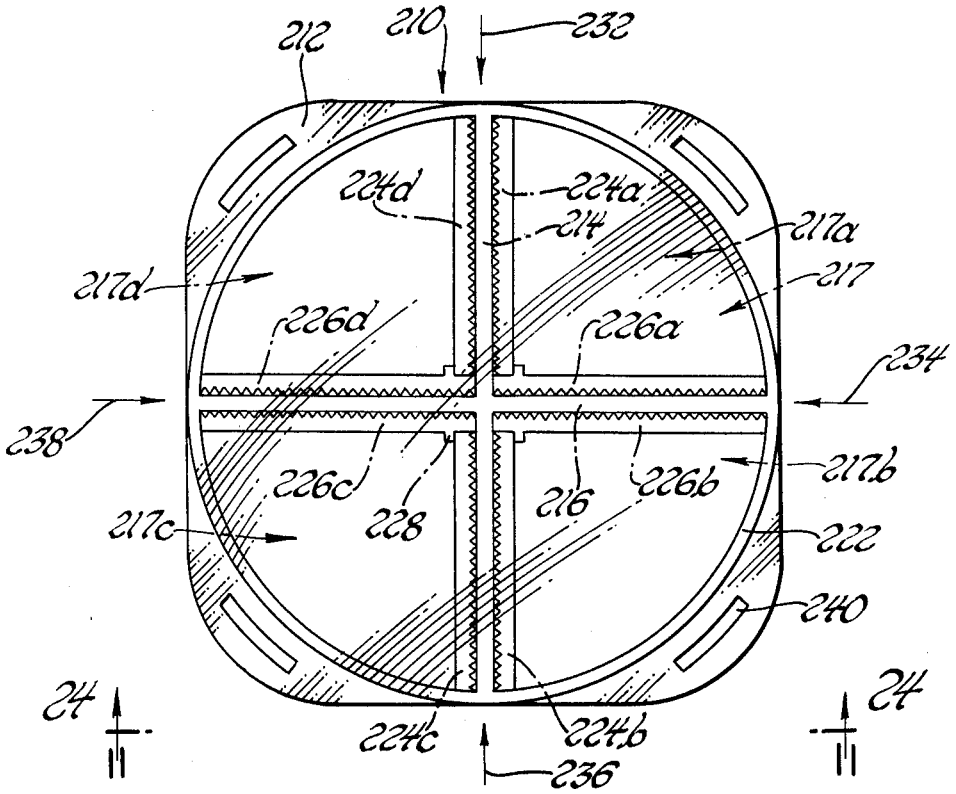
FIG. 23 is a plan view of another embodiment of a pavement marker according to the present invention for use at intersections.
Figure 24:
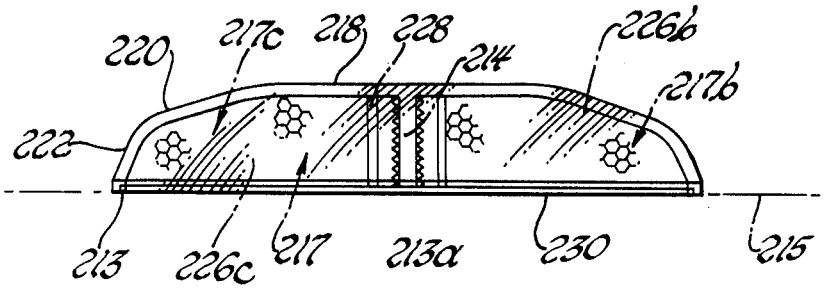
FIG. 24 is an elevational view of the pavement marker of FIG. 23 taken on lines 24—24 of FIG. 23.

FIGS. 23 and 24 indicate an embodiment of the invention particularly suitable for installation at intersections, such as indicated at X in FIG. 12. In FIGS. 23 and 24, reference numeral 210 designates a shell-like body having a base member 212 for engagement with the surface of a roadway. Reference numeral 215 indicates a base plane, and the body 210 has an endless peripheral edge portion 213 lying in the base plane 215. In the embodiment of FIGS. 23 and 24, the peripheral edge portion 213 is circular.

The body 210 includes a pair of ribs 214 and 216 intersecting each other at the center of the circular peripheral edge portion, the ribs 214 and 216 being perpendicular with respect to each other, and each having an upper edge portion joined integrally to the inner surface of the body 210, and a lower edge portion 213*a* (FIG. 24) located substantially in the base plane 215. The body 210 is of dome-like configuration and projects from the base plane to define a chamber 217 with its inner surface, the intersecting ribs 214 and 216 dividing the chamber 217 into four compartments or quadrants 217*a*, 217*b*, 217*c* and 217*d*.

The body 210 includes an outer wall extending from the upper edges of the ribs 214 and 216 to the peripheral edge portion 213 in the base plane 215. The outer wall includes a top portion 218 which is substantially flat as shown in FIG. 24, an integral intermediate portion 220 sloping downwardly from the outer periphery of the top portion 218, and an integral skirt portion 222 extending between the outer periphery of the intermediate portion 220 and the peripheral edge portion 213. The ribs 214 and 216 extend along diameters of the circular body 210.

Marker means is provided in the chamber 217, the marker means comprising a nighttime marker element disposed against the portion of each of the ribs 214 and 216 located in each of the quadrants 217*a*, *b*, *c* or *d*. Thus, marker elements 224*a*, *b*, *c* and *d* are located in the respective quadrants or compartments 217*a*, *b*, *c* and *d*. The marker element 224*a* is disposed against the portion of the rib 214 that is located in quadrant 217*a*, and marker elements 224*b*, *c* and *d* are disposed against the portions of rib 214 located in the respective quadrants 217*b*, *c* and *d*. Marker elements 226*a*, *b*, *c* and *d* are respectively disposed against the portions of rib 216 located in compartments 217*a*, *b*, *c* and *d*.

The marker elements 224*a–d* and 226*a–d* are in the form of reflector bodies formed on their inner surfaces with retro-directive reflector elements, preferably of the cube corner type. The reflector elements are disposed in opposed relationship with the surfaces of the respective ribs 214 and 216. In the illustrated embodiment, locating ribs 228 are formed on each of the reflector bodies 226*a–d* for engaging the ends of the respective reflector bodies 224*a–d*.

A circular closure plate 230 is joined at its periphery to the edge 213. As in the previously described embodiments, a desiccant material (not shown) may be provided on the upper surface of the closure plate 230 to prevent accumulation of moisture in the compartments 217*a–d* of the chamber 217.

As in the previously described embodiments, the closure plate 230 may be sealingly engaged with the edge portion 213 by sonic welding or the like at the factory, or, upon installation, the adhesive material used to secure the pavement marker to the surface may hermetically seal the chamber 217.

The body 210 is of transparent material. When located at an intersection such as indicated at position X in FIG. 12, the ribs 214 and 216 are aligned with the branches of the intersection. Thus, light rays in the direction of arrows 232 are reflected by the reflector bodies 226*a* and 226*b*. Light rays in the direction of arrow 234 are reflected by the reflector bodies 224*a* and *b*. Light rays in the direction of arrow 236 are reflected by reflector bodies 226*b* and *c*, while light rays in the direction of arrow 238 are reflected by the reflector bodies 224*c* and *d*.

Slots 240 are formed in the base member 212, and the bottom surface of the base member 212, as well as that of the closure plate 230, may be formed with ridges corresponding to the ridges 62 and 64 of FIG. 7. The base member 12 (as well as the closure plate 230) may also be provided with support studs corresponding to the support studs 68 in FIGS. 7 and 7*a*.

The slots 240 may also be replaced by tapered holes such as the tapered holes 66 in the embodiment of FIGS. 1–7.

In each embodiment shown in the drawings, horizontal light rays from vehicle lights incident on the transparent outer wall of the chamber in which the nighttime markers are received will first be refracted downardly through the transparent outer wall and will then continue horizontally to the reflector body in the chamber to strike the outer surface of the reflector body. The retro-directive reflector element on the inner surface of the reflector body will reflect the light substantially along the same line to the outer wall, the reflected light ray being refracted upwardly and reflected horizontally substantially the line of incidence.

Each of the disclosed embodiments includes an open-ended, shell-like body of dome-like configuration defining a chamber therein with at least one rib in the chamber integrally joined to the inner surface of the shell-like body. A reflector member is received in the chamber of each embodiment, the reflector member being formed with retro-directive reflector elements for reflecting light rays incidental on the transparent outer wall of the chamber through the transparent outer wall, and closure means is secured to the open end of the shell-like body to close the chamber.

Thus, in the embodiment of FIGS. 1–7, the pavement marker comprises an open-ended, shell-like body 10 of dome-like configuration defining a chamber 17 therein with at least one rib 16, 30, 32, 38–44 integrally joined to the inner surface of the body 10, and a reflector member 52 received in the chamber 17. The reflector member 52 is formed with retro-directive reflector elements for reflecting light rays incident on the transparent outer wall 18 of the chamber 17. Closure means 50 is secured to the open end of the body 10 to close the chamber 17.

Figure 21:
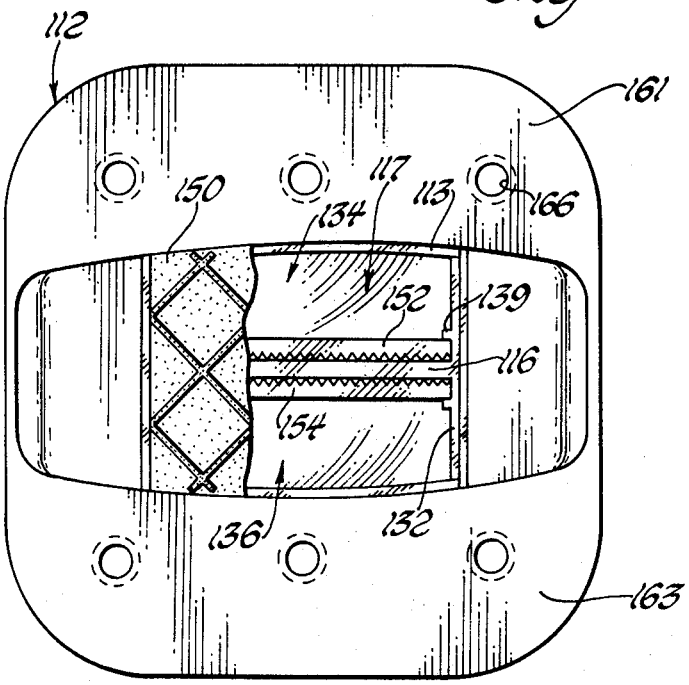
FIG. 21 is a bottom plan view taken on lines 21—21 of FIG. 20.

The pavement marker illustrated in FIGS. 19–21 includes an open-ended, shell-like body 110 of dome-like configuration defining a chamber 117 therein, at least one rib 116 in chamber 117 integrally joined to the inner surface of the body 110, and a reflector member 154 received in the chamber 117. The reflector member 154 is formed with retro-directive reflector elements for reflecting light rays incident on the transparent outer wall 118 of the chamber 117 through the transparent outer wall 118. Closure means 150 is secured to the open end of the shell-like body 110 to close the chamber 117.

In FIGS. 23 and 24, the pavement marker includes an open-ended, shell-like body 210 of dome-like configuration defining a chamber 217 therein with at least one rib 214, 216 in chamber 217 integrally joined to the inner surface of the body 210 with a reflector member 224, 226 received in the chamber 217. The reflector is formed with retro-directive reflector elements for reflecting light rays incident on the transparent outer wall 220, 222 of the chamber through the outer wall, and closure means 230 is secured to the open end of the body 210 to close the chamber 217.

While several specific forms of the invention are described in the foregoing specification and illustrated in the accompanying drawings, it should be understood that the invention is not limited to the exact construction shown. To the contrary, various alterations in the construction and arrangement of parts, all falling within the scope and spirit of the invention, will be apparent to those skilled in the art.

The embodiments of the invention in which an exclusive property or privilege is claimed are defined as follows:

1. A pavement marker comprising: a thin walled, shell-like body of substantially uniform wall thickness with a chamber formed therein; said body being at least partially of transparent material to form a transparent outer wall for said chamber so that the interior of said chamber is visible through said transparent outer wall; and marker means located in said chamber so as to be visible through said transparent outer wall, said marker means being spaced from and out of contact with said transparent outer wall such that there is an air space between said marker means and transparent outer wall whereby light rays striking said transparent outer wall externally of said chamber pass through said transparent outer wall and said air space to strike said marker means.

2. A pavement marker as claimed in claim 1 wherein said body has an endless peripheral edge portion lying substantially in a base plane; said body being of dome-like configuration projecting from said base plane to define said chamber at least in part with its inner surface.

3. A pavement marker as claimed in claim 2 wherein said chamber has an access opening surrounded by said peripheral edge portion, and a closure plate is secured to said body at the peripheral edge portion thereof to form a wall of said chamber.

4. A pavement marker as claimed in claim 3 further including desiccant material in said chamber to prevent the accumulation of moisture therein.

5. A pavement marker as claimed in claim 4 wherein said closure plate is sealingly secured to said peripheral edge portion to hermetically seal said chamber.

6. A pavement marker as claimed in claim 5 wherein said marker means includes at least one night-time marker element operable to reflect light rays incident in said transparent outer wall.

7. A pavement marker as claimed in claim 6 wherein said marker means further includes at least one day-time marker element having an opaque surface visible through said transparent outer wall.

8. A pavement marker as claimed in claim 6 further including a base portion having at least one flange projecting outwardly from the peripheral edge portion of said body and lying substantially in said base plane.

9. A pavement marker as claimed in claim 3 wherein said body has a fore-and-aft axis adapted to extend parallel to the direction of travel when said body is secured to a roadway, and further including a main rib in said chamber extending transversely of the fore-and-aft axis; said main rib having a lower edge lying in said base plane and engaged with said closure plate, and an upper edge spaced from said base plane and integrally joined to the inner surface of said body.

10. A pavement marker as claimed in claim 9 wherein said transparent outer wall extends outwardly from the upper edge of said main rib and downwardly to said base plane.

11. A pavement marker as claimed in claim 10 wherein at least a portion of said outer wall is curved outwardly and downwardly to said base plane.

12. A pavement marker as claimed in claim 11 wherein said outer wall is intersected by the fore-and-aft axis of said body and curves inwardly toward said main rib on opposite sides of said fore-and-aft axis.

13. A pavement marker as claimed in claim 12 further including a pair of spaced, parallel, longitudinal reinforcing ribs extending fore and aft between said main rib and outer wall.

14. A pavement marker as claimed in claim 3 wherein said body is of synthetic resin material.

15. A pavement marker as claimed in claim 3 further including a base, said base having a base flange projecting outwardly from the peripheral edge of said body in said base plane for engagement with the surface of a roadway.

16. A pavement marker as claimed in claim 15 including a plurality of openings in said base flange adapted to provide a mechanical interlock with adhesive material.

17. A pavement marker as claimed in claim 16 including a formation of ridges projecting from the bottom surface of said base flange.

18. A pavement marker is claimed in claim 15 wherein the peripheral edge of said base flange is scalloped to provide a mechanical interlock with adhesive material.

19. A pavement marker as claimed in claim 3 further including a metal base member having a planar base flange and a pair of spaced end sections connected with said base flange, said end sections being of dished configuration and engaging said body on opposite sides of said outer transparent wall.

20. A pavement marker as claimed in claim 19 wherein said body is of synthetic resin material.

21. A pavement marker as claimed in claim 3 wherein said peripheral edge portion is circular.

22. A pavement marker as claimed in claim 21 further including a pair of ribs intersecting each other at the center of said peripheral edge portion, said ribs being perpendicular with respect to each other and having an upper edge portion joined integrally to the inner surface of said body, and a lower edge portion located substantially in said base plane to divide said chamber into quadrants.

23. A pavement marker comprising: a shell-like body with a chamber formed therein; said body being at least partially of transparent material to form a transparent outer wall for said chamber so that the interior of said chamber is visible through said transparent outer wall; and marker means located in said chamber so as to be visible through said transparent outer wall, said body having an endless peripheral edge portion lying substantially in a base plane; said body being of dome-like configuration projecting from said base plane to define said chamber at least in part with its inner surface; said chamber having an access opening surrounded by said peripheral edge portion, a closure plate being secured to said body at the peripheral edge portion thereof to form a wall of said chamber; said body having a fore-and-aft axis adapted to extend parallel to the direction of travel when said body is secured to a roadway, and further including a main rib in said chamber extending transversely of the fore-and-aft axis; said main rib having a lower edge lying in said base plane and engaged with said closure plate, and an upper edge spaced from said base plane and integrally joined to the inner surface of said body; said transparent outer wall extending outwardly from the upper edge of said main rib and downwardly to said base plane; at least a portion of said outer wall being curved outwardly and downwardly to said base plane; said outer wall being intersected by the fore-and-aft axis of said body and curving inwardly toward said main rib on opposite sides of said fore-and-aft axis; a pair of spaced, parallel, longitudinal reinforcing ribs extending fore and aft between said main rib and outer wall; and said marker means includes a central marker element extending between said pair of longitudinal ribs and the upper and lower edge of said main rib.

24. A pavement marker as claimed in claim 23 wherein the space between said longitudinal ribs constitutes a central compartment of said chamber, and wherein said outer wall has a pair of opposite end portions projecting on opposite sides of said longitudinal ribs from said central compartment, said end portions curving abruptly inwardly to the plane of said main rib into generally parallel relationship with the fore and aft axis to define side compartments of said chamber at opposite ends of said central compartment.

25. A pavement marker as claimed in claim 24 including at least one transverse rib extending between each of said outer wall end portions and the adjacent longitudinal rib in parallel relationship with said main rib.

26. A pavement marker as claimed in claim 25 wherein each of said transverse ribs has an upper edge that is inclined downwardly and outwardly from its juncture with the respective longitudinal rib, and an outer edge extending from the end of said upper edge opposite said longitudinal rib to said base plane.

27. A pavement marker as claimed in claim 25 wherein said marker means further includes a side marker element in each of said side marker compartments.

28. A pavement marker as claimed in claim 27 wherein said central marker element comprises a night-time marker element operable to reflect light rays incident on said transparent outer wall.

29. A pavement marker as claimed in claim 28 wherein said side marker element each comprises a day-time marker element having an opaque surface visible through said transparent outer wall.

30. A pavement marker as claimed in claim 29 wherein said side marker elements each comprises a flange projecting from said closure plate.

31. A pavement marker as claimed in claim 30 wherein said night-time marker element comprises a reflector body having an inner surface disposed in opposed relationship with said main rib and formed with a plurality of retro-directive reflector elements.

32. A pavement marker as claimed in claim 31 wherein said retro-directive reflector elements are cube corner reflector elements.

33. A pavement marker as claimed in claim 28 wherein said side marker elements each comprises a night-time marker element operable to reflect light rays incident on said outer transparent wall.

34. A pavement marker as claimed in claim 33 wherein said side marker elements each have outer surfaces and inner surfaces, said inner surfaces being disposed in opposed relationship with the respective transverse rib and formed with a plurality of retro-directive reflector elements each having an apex remote from said outer surface and an axis passing through the apex of each retro-directive reflective element, said reflector elements being oriented such that each retro-directive reflector element axis makes an acute angle with said fore and aft axis and extends outwardly with respect to said central compartment.

35. A pavement marker comprising: a shell-like body with a chamber formed therein; said body being at least partially of transparent material to form a transparent outer wall for said chamber so that the interior of said chamber is visible through said transparent outer wall; marker means located in said chamber so as to be visible through said transparent outer wall; said body having an endless peripheral edge portion lying substantially in a base plane; said body being of dome-like configuration projecting from said base plane to define said chamber at least in part with its inner surface; said chamber having an access opening surrounded by said peripheral edge portion, a closure plate being secured to said body at the peripheral edge portion thereof to form a wall of said chamber; a pair of ribs intersecting each other at the center of said peripheral edge portion, said ribs being perpendicular with respect to each other and having an upper edge portion joined integrally to the inner surface of said body, and a lower edge portion located substantially in said base plane to divide said chamber into quadrants; said marker means comprising a marker element disposed against the portion of each of said ribs located in each quadrant.

36. A pavement marker as claimed in claim 35 wherein said marker elements are each night-time marker elements operable to reflect light rays incident on said body.

37. A pavement marker comprising: a thin walled, shell-like body of substantially uniform wall thickness with a chamber formed therein; said body having an endless peripheral edge portion lying substantially in a base plane; said body being of dome-like configuration projecting from said base plane to define said chamber with said peripheral edge portion surrounding an access opening to said chamber; said body having a fore and aft axis adapted to extend parallel to the direction of travel when said body is secured to a roadway; a main rib in said chamber extending transversely of said fore and aft axis, said main rib having a lower edge lying substantially in said base plane and an upper edge spaced from said base plane and joined integrally to the inner surface of said body; said body having front and rear outer walls extending outwardly in oppoiste directions from the upper edge of said main rib and downwardly to said base plane; said outer walls each having smooth inner and outer surfaces and at least one of said outer walls being transparent to permit light to pass into and out of said chamber; a pair of spaced, parallel longitudinal ribs located on opposite sides of said fore and aft axis and joined integrally to said main rib and to the inner surface of said body to form central compartments in said chamber on opposite sides of said main rib and a marker means disposed within said chamber.

38. A pavement marker as claimed in claim 37 wherein at least a portion of each of said outer walls is curved outwardly and downwardly to said base plane.

39. A pavement marker as claimed in claim 38 wherein said outer walls are intersected by said fore and aft axis and curve inwardly toward said main rib on opposite sides of said fore-and-aft axis.

40. A pavement marker as claimed in claim 39 further including a closure plate secured to said peripheral edge portion to close said chamber and form a bottom wall thereof.

41. A pavement marker comprising: an open-ended, thin walled, shell-like body of dome-like configuration defining a chamber therein; said body having a substantially uniform wall thickness; at least one rib in said chamber integrally joined to the inner surface of said shell-like body; a reflector member received in said chamber, said reflector member being formed with retro-directive reflector elements; said shell-like body being at least partially of transparent material to form a transparent outer wall for said chamber so that the interior of said chamber is visible through said outer wall, said reflector member being enclosed in said chamber, said reflector member being spaced from and out of contact with said outer wall such that there is an air space between said outer wall and said reflector member whereby light rays striking said transparent outer wall externally of said chamber pass through said transparent outer wall and air space to strike said reflector member and are reflected back trhough said air space and transparent outer wall; and closure means secured to the open end of said shell-like body to close said chamber.

42. A pavement marker comprising: an open-ended, shell-like body of dome-like configuration defining a chamber therein; at least one rib in said chamber integrally joined to the inner surface of said shell-like body; said shell-like body having a fore and aft axis adapted to extend parallel to the direction of vehicular travel when said shell-like body is secured to a roadway; said shell-like body being at least partially of transparent material to form a transparent outer wall for said chamber so that the interior of said chamber is visible through said outer wall, said fore and aft axis intersecting said outer wall; a central, night-time marker element received in said chamber, said central night-time marker element comprising a reflector body having inner and outer surfaces extending transversely of and intersected by said fore and aft axis; a plurality of retro-directive reflector elements formed on said inner surface, each of said retro-directive reflector elements having an apex remote from said outer surface and an axis passing therethrough that is parallel to said fore and aft axis; said reflector body being disposed in said chamber such that the outer surface is disposed adjacent to said outer wall to receive light rays incident on said outer wall and said inner surface is disposed on the opposite side of said outer surface from said outer wall such that said light rays incident on said outer wall are reflected through said outer wall by said retro-directive reflector elements; a closure plate secured to the open end of said shell-like body to close said chamber; and a pair of side marker elements projecting from said closure plate at opposite ends of said reflector body, said side marker elements each having an opaque surface parallel to said outer surface of said reflector body located to be visible through said transparent outer wall.

43. A pavement marker comprising: an open-ended, shell-like body of dome-like configuration defining a chamber therein; at least one rib in said chamber integrally joined to the inner surface of said shell-like body; said shell-like body having a fore and aft axis adapted to extend parallel to the direction of vehicular travel when said body is secured to a roadway; said shell-like body being at least partially of transparent material to form a transparent outer wall for said chamber so that the interior of said chamber is visible through said outer wall, said fore and aft axis intersecting said outer wall; a central, night-time marker element received in said chamber, said central night-time marker element comprising a central reflector body having inner and outer surfaces extending transversely of and intersected by said fore and aft axis; a plurality of retro-directive reflector elements formed on said inner surface of said central reflector body, each of said retro-directive reflector elements having an apex remote from said outer surface and an axis passing therethrough that is parallel to said fore and aft axis; said central reflector body being disposed in said chamber such that the outer surface thereof is disposed adjacent to said outer wall to receive light rays incident on said outer wall and the inner surface thereof is disposed on the opposite side of said outer surface from said outer wall such that said light rays incident on said outer wall are reflected through said outer wall by said retro-directive reflector elements; a pair of night-time side marker elements in said chamber located at opposite ends of said central marker element, each of said side marker elements comprising a side reflector body having inner and outer surfaces extending transversely of said fore and aft axis; a plurality of retro-directive reflector elements formed on the inner surface of each of said side reflector bodies, each retro-directive reflector element of said side reflector bodies having an apex remote from the outer surface of the respective side reflector body and an axis passing therethrough; each of said side reflector bodies being disposed in said chamber such that the outer surface thereof is disposed adjacent to said outer wall to receive light rays incident on said outer wall and the inner surface thereof is disposed on the opposite side of said outer surface from said outer wall such that said light rays incident on said outer wall are reflected through said outer wall by said retro-directive reflector elements; the axis of each of said retro-directive reflector elements of said side reflector bodies extending outwardly at an acute angle with respect to said fore and aft axis in the direction of the outer wall of said shell-like body; and a closure member secured to the open end of said shell-like body to close said chamber.

44. A pavement marker comprising: an open-ended shell-like body of dome-like configuration defining a chamber therein; at least one rib in said chamber integrally joined to the inner surface of said body; said body having a fore and aft axis adapted to extend parallel to the direction of vehicular travel when said body is secured to a roadway; said shell-like body being at least partially of transparent material to form a transparent outer wall for said chamber so that the interior of said chamber is visible through said outer wall, said fore and aft axis intersecting said outer wall; a night-time marker element received in said chamber, said night-time marker element comprising a reflector body having inner and outer surfaces extending transversely of and intersected by said fore and aft axis; a plurality of retro-directive reflector elements formed on said inner surface of said reflector body, each of said retro-directive reflector elements having an apex remote from said outer surface and an axis passing therethrough that is parallel to said fore and aft axis; said reflector body being disposed in said chamber such that the outer surface thereof is disposed adjacent to said outer wall to receive light rays incident on said outer wall and the inner surface thereof is disposed on the opposite side of said outer surface from said outer wall such that said light rays incident on said outer wall are reflected through said outer wall by said retro-directive reflector elements; a closure plate secured to the open end of said shell-like body to close said chamber; and a metal base member having a pair of oppositely projecting planar base flanges; a pair of end sections spaced from each other on opposite sides of said fore and aft axis and connecting said flanges; said end sections each being of dished configuration with the inner peripheries overlying said shell-like body adjacent the opposite ends of said reflector body.

45. A pavement marker comprising: an open-ended, shell-like body of dome-like configuration defining a chamber therein; a pair of ribs in said chamber intersecting each other at a right angle, each integrally joined to the inner surface of said shell-like body, said ribs dividing said chamber into four compartments; said shell-like body being of transparent material to form a transparent outer wall for said chamber so that the interior of said chamber and each of said compartments is visible through said outer wall; a pair of night-time marker elements disposed at right angles with respect to each other in each of said compartments, each of said marker elements comprising a reflector body having inner and outer surfaces with a plurality of retro-directive reflector elements formed on the inner surface; each reflector body being disposed in its respective compartment such that the inner surface is disposed adjacent to one of said ribs and the outer surface is disposed on the opposite side of said inner surface from said one rib to receive light rays incident on said outer surface from a direction generally transverse to said one rib such that said light rays are reflected through said outer wall by said retro-directive reflector elements; and a closure plate secured to the open end of said shell-like body to close said chamber.

46. A pavement marker comprising: an open-ended, shell-like body of dome-like configuration defining a chamber therein; a main rib in said chamber integrally joined to the inner surface of said shell-like body; said shell-like body having a fore and aft axis adapted to extend parallel to the direction of vehicular travel when said shell-like body is secured to a roadway, said shell-like body being at least partially of transparent material to form a transparent outer wall for said chamber so that the interior of said chamber is visible through said outer wall, said fore and aft axis intersecting said outer wall and said main rib; a night-time marker element received in said chamber, said night-time marker element comprising a reflector body having inner and outer surfaces extending transversely of and intersected by said fore and aft axis; a plurality of retro-directive reflector elements formed on said inner surface; said reflector body being disposed in said chamber such that the outer surface is disposed adjacent to said outer wall to receive light rays incident on said outer wall and said inner surface is disposed on the opposite side of said outer surface from said outer wall and in opposed relationship to said main rib such that said light rays incident on said outer wall are reflected through said outer wall by said retro-directive reflector elements; and closure means hermetically sealing at least the space between said inner surface and said main rib.

* * * * *